United States Patent [19]

Barrois et al.

[11] 4,454,813

[45] Jun. 19, 1984

[54] INKING UNIT

[75] Inventors: Claus D. Barrois, Marktheidenfeld; Philipp A. Dieterich, Randersacker, both of Fed. Rep. of Germany

[73] Assignee: Koenig & Bauer Aktiengesellschaft, Wurzburg, Fed. Rep. of Germany

[21] Appl. No.: 506,954

[22] Filed: Jun. 22, 1983

[30] Foreign Application Priority Data

Jul. 7, 1982 [DE] Fed. Rep. of Germany ..... 3225378

[51] Int. Cl.[3] ..... B41F 31/16; B41L 27/18

[52] U.S. Cl. ..... 101/349; 101/148; 101/DIG. 7

[58] Field of Search ..... 101/202, 205–210, 101/332, 335, 336, 349–352, 156, 168, DIG. 7, 148; 118/106, 261

[56] References Cited

U.S. PATENT DOCUMENTS

| | | | |
|---|---|---|---|
| 139,171 | 5/1873 | Maurice | 101/DIG. 7 |
| 549,976 | 11/1895 | Robertson | 101/DIG. 7 |
| 773,444 | 10/1904 | Wesser | 101/202 X |
| 1,840,009 | 1/1932 | Ball et al. | 101/DIG. 7 |
| 3,366,046 | 1/1968 | Szasz | 101/202 X |
| 3,888,172 | 6/1975 | D'Amato et al. | 101/168 X |

FOREIGN PATENT DOCUMENTS

| | | |
|---|---|---|
| 901057 | 1/1954 | Fed. Rep. of Germany . |
| 2323025 | 11/1973 | Fed. Rep. of Germany . |

*Primary Examiner*—J. Reed Fisher

*Attorney, Agent, or Firm*—Jones, Tullar & Cooper

[57] ABSTRACT

An inking unit for use in a rotary printing machine is disclosed. A plurality of endless belts are placed side by side along the surface of a driving roller. These belts transport a liquid medium such as printing ink or damping fluid along the surface of a covering of a cylinder in the direction of the longitudinal axis of the cylinder. The liquid medium is transported by the belts from a position of excess ink to a position of less ink thereby ensuring a uniform distribution of the liquid along the surface of the roller.

3 Claims, 5 Drawing Figures

INKING UNIT

FIELD OF THE INVENTION

The present invention is directed generally to an inking unit for a printing machine. More particularly, the present invention is directed to an ink transport apparatus for distributing ink evenly on the surface of an inking cylinder. Most specifically, the present invention is directed to an ink transport apparatus which utilizes a plurality of endless belts and ink transfer rollers to evenly distribute the ink. Several ink relief equalizing rollers are spaced about, and in contact with, the periphery of an inking cylinder. Each of these ink relief equalizing rollers is contacted by one or more endless ink equalizing belts. These belts travel in a closed path and also contact ink transfer rollers or an ink transfer belt at a point away from their contact with the ink relief equalizing cylinder. The liquid medium such as ink is evenly distributed by the endless belts along the surface of the ink relief equalizing cylinders and hence on the surface of the inking cylinder. This assures uniform ink distribution to the printing plates which contact the inking cylinder.

DESCRIPTION OF THE PRIOR ART

Ink transport mechanisms that are used to distribute a liquid medium such as printing ink longitudinally along the surface of a covering on a cylinder are known generally in the art of printing machinery engineering. Typically, such ink transport means are in the form of oscillating rollers. There is, however, a limit to the longitudinal distance which each of these rollers can move or oscillate in, and it is therefore necessary to provide a number of these oscillating rollers. Each of these rollers must cooperate with, and be in adjustment with each other in order to provide a transport path along the entire length of the cylinder. As can be well understood, the coodination of these various transport rollers is often quite difficult.

A so-called short inking unit is disclosed in German Pat. No. 2,323,025. This apparatus provides a device which allows the equalization of a relief of a residual ink thickness layer so that the undesirable stencilling effect is avoided. This unit does not require any ink zone adjusting screws. However, this unit does require a doctor blade and, as is well known in the art, such doctor blade assemblies do not wear evenly along their lengths. The non-uniform wear creates uneven ink thicknesses across the length of the cylinder. This prior art inking unit uses an inking roller and a metering roller which rotates in the same direction and at different speeds. There is a substantial likelihood of damage to one or both of the cylinders particularly if the inking unit is allowed to operate dry.

It can, accordingly be appreciated that the prior art ink transport and metering assemblies have been complex, expensive, and less than completely satifactory in use. The problem of nonuniform ink distribution has not been solved by these prior art devices and remains a problem.

SUMMARY OF THE INVENTION

It is an object of the present invention to provide an inking unit for a printing machine.

A further object of the present invention is to provide an ink transport apparatus.

Another object of the present invention is to provide an ink transport unit for distributing the liquid medium longitudinally along a cylinder.

Yet a further object of the present invention is to provide an ink transport unit which requires no oscillating cylinders.

Still another object of the present invention is to provide an apparatus for transporting a liquid medium which uses a plurality of endless belts.

A still further object of the present invention is to provide an ink transport unit which includes ink transfer means in contact with the endless belts.

As will be set forth in greater detail in the description of the preferred embodiment, the inking unit in accordance with the present invention utilizes a plurality of endless belts to effect ink distribution longitudinally along an inking cylinder. A plurality of ink relief equalizing cylinders are spaced adjacent each other and about the periphery of the inking cylinder. These ink relief equalizing cylinders are, in turn, each contacted by a plurality of endless belts carried by a driven roller. The endless belts are also in contact with ink transfer rollers or an ink transfer belt at a point remote from their contact with the ink relief equalizing cylinders. This assembly thereby facilitates the uniform distribution of the liquid medium. It should be noted that the apparatus in accordance with the present invention can be used where any liquid medium is to be transported longitudinally on a cylinder cover. Thus the assembly could be used with printing ink, damping fluid, coating fluid or other such fluids without the need for an oscillating cylinder.

In a contemplated usage, the inking unit in accordance with the present invention may be used in a rotary printing press to reduce or eliminate any non-uniformity of ink layer thickness relief longitudinally along the length of an inking cylinder. This can be accomplished without the need to use a doctor blade. Even a large ink layer thickness relief or variation can be modified along the longitudinal length of an inking cylinder by use of the present apparatus to such an extent that the degree of non-uniformity will be so minimal that it will not effect the printed product.

It has been practically impossible to obtain an ink layer of a selectible thickness on an inking cylinder with any uniformity along the longitudinal length of the cylinder. However, this result must be accomplished in order to eliminate the mechanisms for ink zone width adjustment and pre-adjustment of the ink quantity in an inking unit. Such units, which are commonly in wide usage, are quite expensive. The inking unit in accordance with the present invention allows ink thickness equalization along the entire length of an inking cylinder in a short time even in situations where the maximum and minimum ink thicknesses are widely spaced from each other to such an extent that they could not be mixed by the use of an oscillating motion type of ink distributing cylinder. It is accordingly possible to print extreme formes without noticing any stencilling effect on the printed product.

When used with a printing unit using damping fluid, the subject invention facilitates the evaporation of any damping fluid which may remain in the printing ink after printing. Accordingly, the ink film which returns to the inking unit is as free of damping fluid as possible. The ink which returns to the inking unit is kept elastic because of the large number of ink splitting points.

The inking unit in accordance with the present invention is also usable to stop "printing ink splashing". This splashing is frequently noticeable in inking units used in offset rotary printing machines that are equipped with alcohol damping units. In these devices, the ink splashing is frequently a problem when easily emulsified printing inks are being used. These inks have a number of advantages and cannot be readily dispensed with. Small lumps of an emulsion of printing ink and damping fluid are apt to be thrown off the inking unit cylinders by centrifugal force. These particles soil the paper web and parts of the printing machine. This ink splashing is most frequently noticed if the paper web being printed has a width less than the maximum paper width which can be used. This is a problem particularly if so called "bled-off" images are being printed. These images are ones which are printed on the web up to or nearly up to the side edge of the paper. It is in this edge zone that a relatively thin emulsion of printing ink and damping fluid is formed on the cylinder. This emulsion is then thrown off to soil the paper web and possibly cause web breakage. The inking unit in accordance with the present invention can be used to prevent this ink splashing by keeping the ink and any damping fluid from being thrown off the inking cylinder.

BRIEF DESCRIPTION OF THE DRAWINGS

While the novel features of the inking unit in accordance with the present invention are set forth with particularity in the appended claims, a full and complete understanding of the subject invention may be had by referring to the detailed description of the preferred embodiment as set forth hereinafter and as may be seen in the accompanying drawings in which:

DESCRIPTION OF PREFERRED EMBODIMENTS

Figure 1:
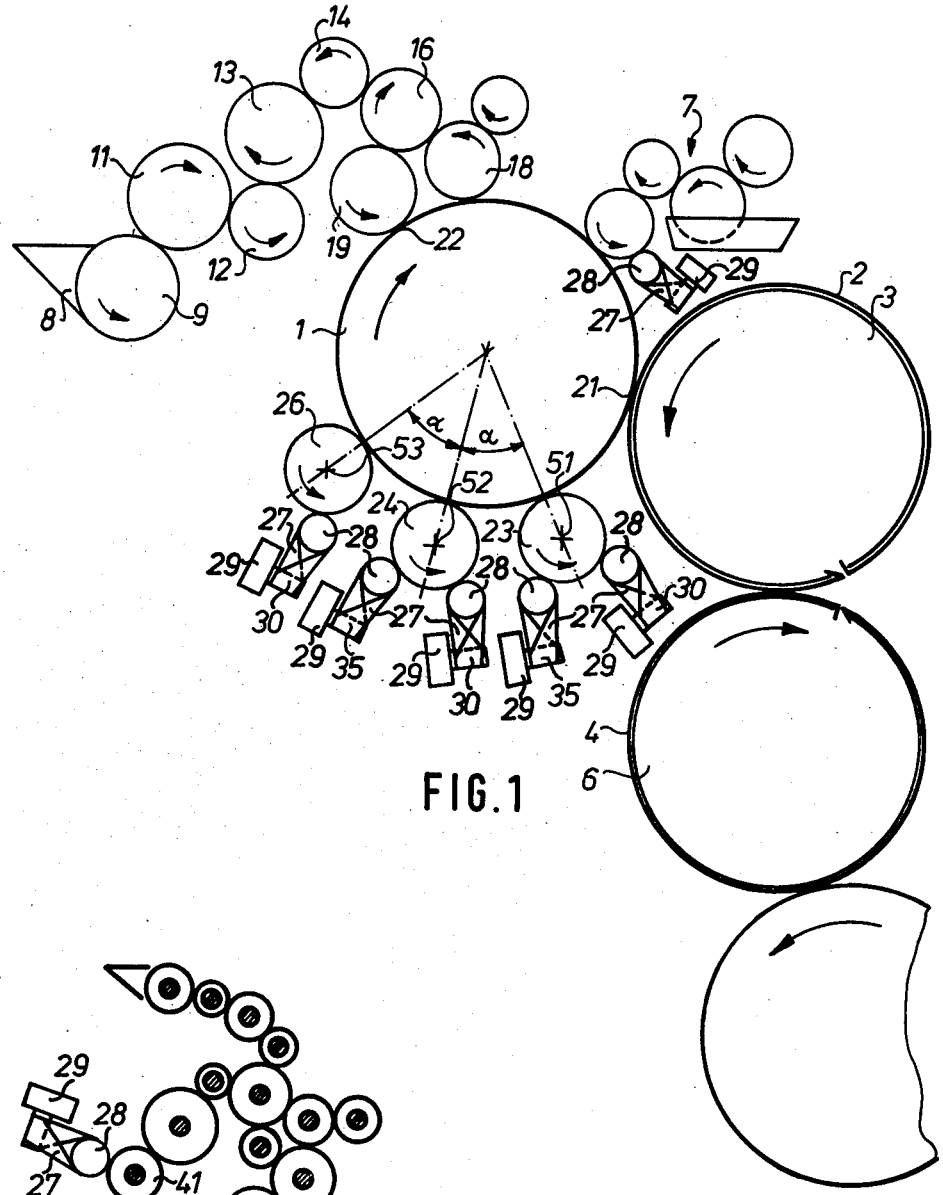
FIG. 1 is a schematic side elevation view of an inking unit in accordance with the present invention with the side frames of the assembly removed for clarity.

Referring initially to FIG. 1, there may be seen an inking unit for use in a rotary printing machine in accordance with the subject invention. Ink is applied to a rubber-covered inking cylinder 1 in a generally conventional manner and is then used to ink a printing plate 2. Plate 2 may be an offset printing plate and is secured to the surface of a forme cylinder 3. The printing plate 2 transfers its ink to a rubber blanket 4 that is carried by a blanket cylinder 6. The inking cylinder 1, forme cylinder 3, and blanket cylinder 6 are all preferably the same diameter and are driven at equal peripheral speeds in a known manner. Inking cylinder 1 and printing plate 2 may be dampened by a damping unit generally at 7.

Inking cylinder 1 receives its ink from an ink duct 8 that is preferably not equipped with ink zone adjusting screws. To provide a relatively even ink film, the film inking unit shown in FIG. 1, or a vibrator inking unit can be used. These inking units are generally well known in the art, as may be seen in German Pat. No. 901,057 and no detailed description thereof is believed necessary. Printing ink supplied by ink duct 8 is conveyed by a duct roller 9, whose speed of rotation can be varied, and by a train of intermediate cylinders 11, 12, 13, 14 and 16 to first and second transfer cylinders 18 and 19, respectively. Both of the transfer cylinders 18 and 19 contact the surface of the inking cylinder 1. Duct roller 9, intermediate cylinders 11, 12, 13, 14 and 16, and transfer cylinders 18 and 19 have diameters smaller than the diameter of the inking cylinder 1. Cylinders 11, 12, 13, 14, 16, 18 and 19 also have peripheral speeds the same as that of inking cylinder 1. Cylinders 14, 18 and 19 are constructed as oscillating ink distributing cylinders.

As may be seen in FIG. 1, a plurality of rotating ink relief equalizing cylinders such as the three cylinders 23, 24 and 26 are spaced about the periphery of inking cylinder 1. These are located preferably intermediate contact point 21 where inking cylinder 1 contacts forme cylinder 3 and contact point 22 where inking cylinder 1 contacts ink transfer cylinder 19. The three ink relief equalizing cylinders 23, 24 and 26 are spaced from each other at an angle $\alpha$ which, in the preferred embodiment is 30°. They may have the same diameters as the first and second ink transfer cylinders 18 and 19, and are provided with a hard oleophilic covering which accepts printing inks. This covering may be, for example, ceramic or copper. The ink relief equalizing cylinders 23, 24 and 26 rotate under pressure against the surface of the inking cylinder 1.

Figure 2:
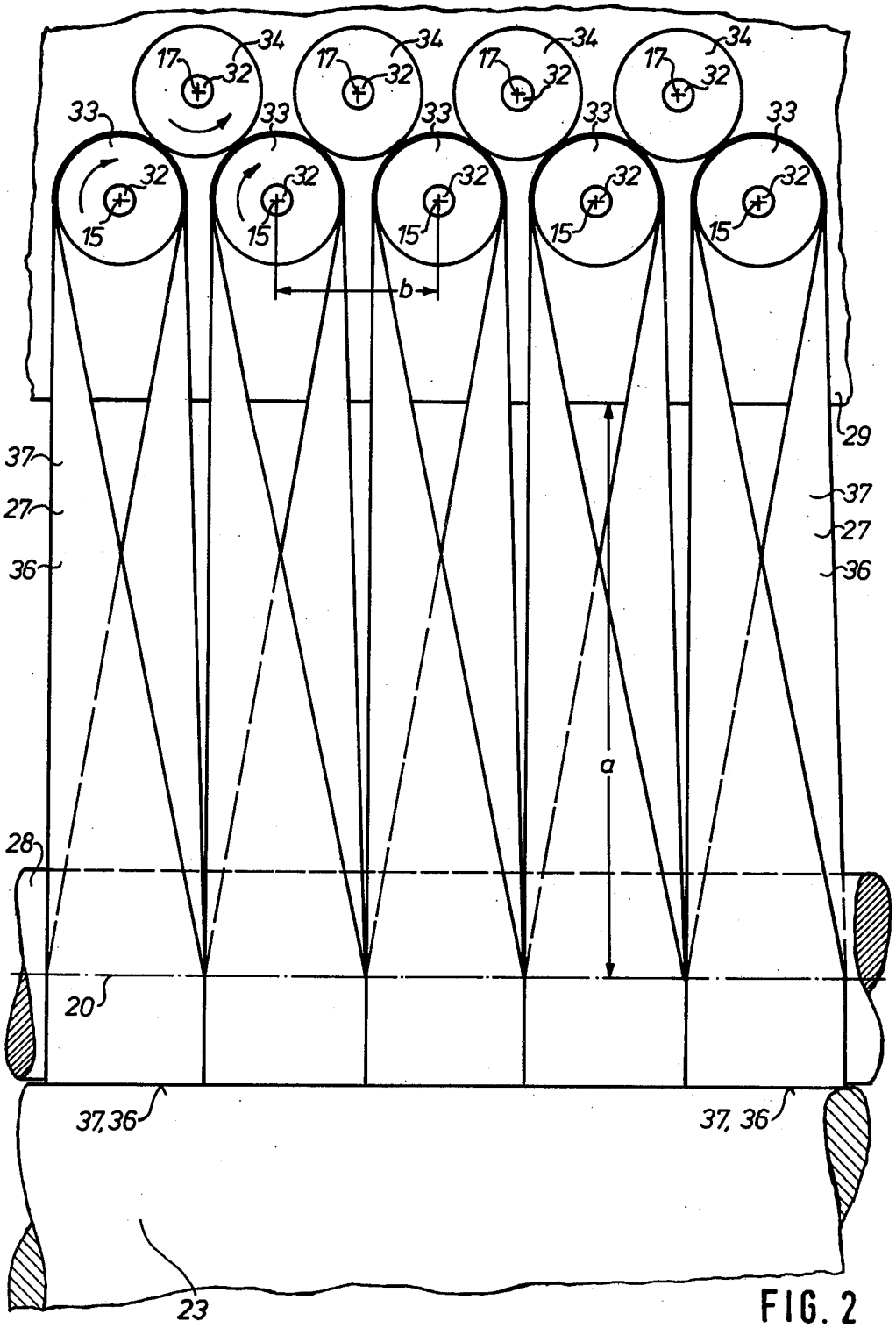
FIG. 2 is a schematic front view of a first embodiment of an inking cylinder utilizing the inking unit in accordance with the present invention.
Figure 3:
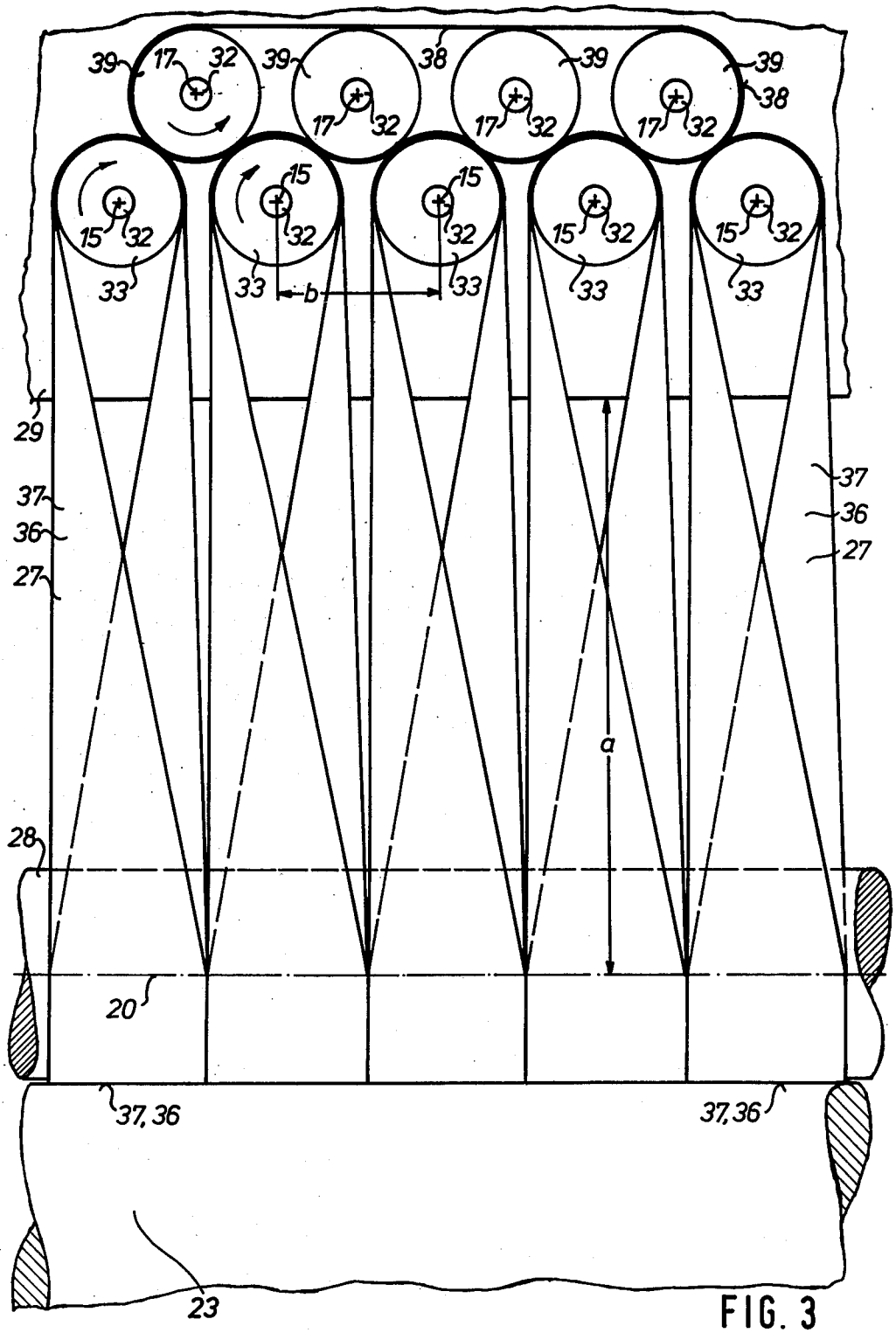
FIG. 3 is a schematic front view of a second embodiment of an inking cylinder utilizing the inking unit in accordance with the present invention.

Turning now to FIGS. 2 and 3 in conjunction with FIG. 1, one or more series of driven, endless ink equalizing belts 27 such as first and second series 30 and 35, respectively, are mounted for cooperation with each of the ink relief equalizing cylinders 23, 24 and 26. Each of the series 30 and 35 of belts 27 comprises, for example 20 such belts 27 with the exact number being dependent on the printing width. These belts are positioned adjacent each other and may either be spaced from each other or may be in edge abutting relationship. Each of the belts 27 has a width of, in the preferred embodiment 40 mm, and each belt 27 has an outer surface 36 which carries an oleophilic layer 37 of, for example rubber, that accepts printing ink.

One or more driving rollers 28 are suitably journaled in the side frames (not shown). Each of these rollers acts as the drive means for a group of the belts 27 and may be driven either by the main drive for the printing machine in a conventional manner, or may be provided with suitable individual drive means such as, for example electric motors having speed regulation means. A support plate 29 is secured to the side frames at a distance "a" from the drive roller 28. A plurality of stub axles or shafts 32 are welded or otherwise affixed to support plate 29 and extend out from plate 29 at an angle of generally 90° to the longitudinal axis of rotation 20 of driving roller 28. These stub axles 32 are, as may be seen in FIG. 2, staggered from each other in two horizontal rows with each axle being spaced a distance "b" from the adjacent axle in the same row. A guide pulley 33 is secured to each axle 32 in the lower row and an ink transfer roller 34 is carried by each axle 32 in the upper row. Each guide pulley 33 supports one belt 27 which extends between the guide pulley 33 and the driving roller 28. An ink transfer roller 34 contacts the outer surfaces 36 of two adjacent belts 27 as they pass over guide pulleys 33. This presses the belts 27 against the guide pulleys 33. In addition, since the ink transfer rollers 34 are provided with oleophilic coating or covering that may be, for example rubber, the printing ink carried by the surfaces 36 of the belts 27 is transferred from belt to belt by ink transfer rollers 34.

As was indicated previously, the axes of rotation 15 and 17 of the guide pulleys and the ink transfer rollers 33 and 34, respectively extend parallel to each other. The axis of rotation 20 of the driven roller 28 and the axes of rotation 15 and 17 of the guide pulleys 33 and the ink transfer rollers 34 are located on separate levels which are parallel to each other. A vertical plane which is perpendicular to the axes of rotation 15 and 17 would be perpendicular to a horizontal plane extending along the axis of rotation 20 of the driving roller 28. Thus, as may be seen in FIGS. 2 and 3, each of the belts 27 is given a twist as it passes between the driving roller 28 and the cooperating guide pulley 33.

It would also be possible to locate the ink transfer rollers 34 below and between the guide pulleys 33 in an orientation not shown in the drawings. In this array, two adjacent belts 27 would each be wound partially about the surface of a cooperating ink transfer roller 34. In either situation, printing ink or an emulsion of printing ink and damping fluid is transported from the surface of the ink relief equalizing cylinder 23 by the surface 36 of a first belt 27 to the surface of an ink transfer roller 34 and then to the surface 36 of a second adjacent belt 27 and back onto the surface of the ink relief equalizing cylinder 23. This accomplishes the equalization of the ink thickness on the surface of ink relief equalizing cylinder 23 and on the surface of the inking cylinder 1.

As may be seen in FIG. 3 of the drawings, the second embodiment of the present invention utilizes an endless ink transport belt 38 instead of the ink transfer rollers 34. Ink transport belt 38 is carried by a plurality of pressure rollers 39 that are rotatably supported on stub axles 32. The generally horizontal ink transport belt 38 engages the surfaces 36 of a plurality of the vertical belts 27 and transports the printing ink carried by the vertical belts 27 between adjacent belts. Thus the ink transfer rollers 34 and the horizontal ink transfer belt 38 are generally analogous and form mobile transfer means whose purpose is to transfer the printing ink or ink and damping fluid emulsion from one vertical belt 27 to another.

Printing ink thickness equalization in the direction of the longitudinal axes of the ink relief equalizing cylinders 23, 24 and 26 is accomplished by the placement of a plurality of the belts 27 in a side by side array along part of, or the entire length of the driving roller 28. This equalization is accomplished by a transfer of ink from an area of increased ink thickness to an area of lesser ink thickness so that an ink film of uniform thickness is longitudinally formed along the length of the cylinder.

The guide pulleys 33 can either all be driven in the same direction or can be driven in alternate direction with respect to each other depending on how the belts 27 are placed on the guide pulleys 33. If the direction of rotation of adjacent guide pulleys 33 is the same, one or an odd number of ink transfer rollers 34 are used. Each such transfer roller 34 contacts the surfaces 36 of two adjacent belts 27. If the direction of rotation of adjacent guide pulleys 33 are different, two or an even number of ink transfer rollers 34 are used. In the situation in which a plurality of ink transfer rollers 34 are disposed between two belts 27, the first and last ink transfer roller 34 are in contact through belts 27 with the guide pulley 33 coordinated to it.

Figure 4:
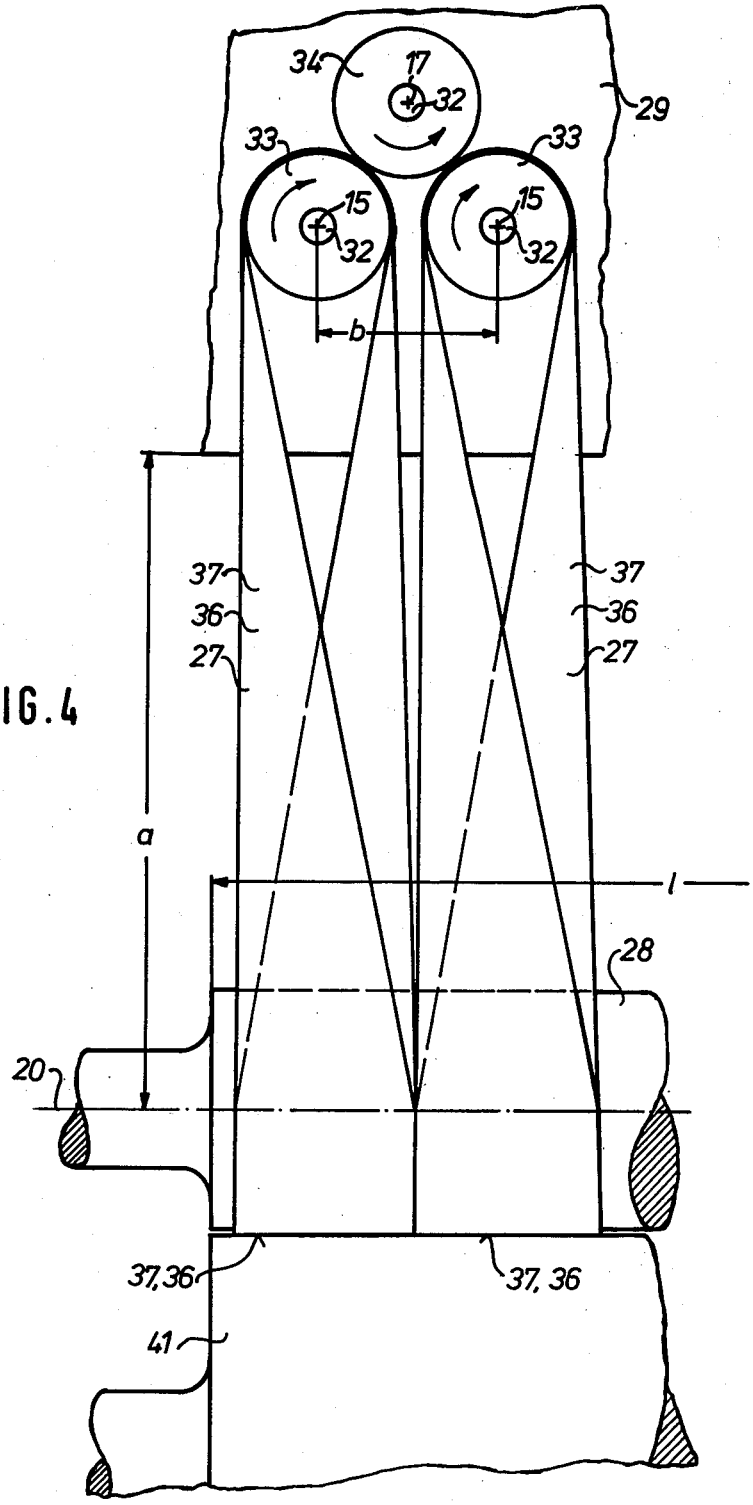
FIG. 4 is a schematic front view of the inking unit in accordance with the present invention for use to prevent printing ink splashing.

Turning now to FIG. 4, there may be seen an inking unit assembly intended for use to prevent printing ink splashing. In this mode, only the portion of the driving rollers 28 where ink splashing occurs are provided with belts 27. Only the portion of the surface of an inking unit roller 41 where the emulsion of printing ink and damping fluid is apt to occur is provided with belts 27. Thus, as seen in FIG. 4 only two or three belts 27 may be provided at, for example the ends of the inking unit roller 41. A slide (not shown) may be provided on support 29 so that the location of the guide pulleys 33 and ink transport rollers 34 may be shifted longitudinally with respect to the axis of rotation of the inking unit roller 41 so that the belts 27 can be positioned at the point where the ink splashing occurs. This slide is capable of being locked in place once it is properly positioned.

Figure 5:
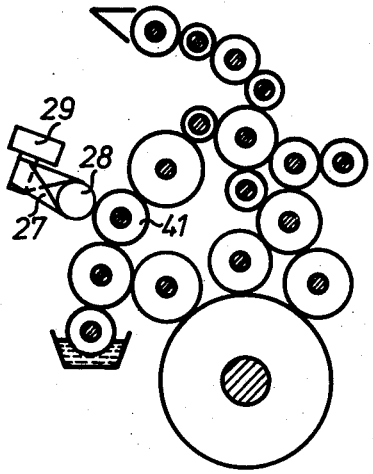
FIG. 5 is a schematic view of the inking unit in accordance with the present invention as shown in FIG. 4 installed in a conventional inking unit.

As may be seen in FIG. 1, an inking unit in accordance with the present invention may be used with a conventional damping unit 7. This ensures that the damping fluid is applied to the surface of the inking cylinder 1 in a uniform thickness. FIG. 5 shows the positioning of an inking unit in accordance with the present invention in cooperation with an inking unit roller 41 of a conventional inking unit.

While preferred embodiments of an inking unit in accordance with the present invention has been fully and completely disclosed hereinabove, it will be obvious to one of ordinary skill in the art that a number of changes in, for example, the number of belts 27 used, the nature of their surface composition, the number of rotating ink relief equalizing cylinders and the like could be made without departing from the true spirit and scope of the present invention which is accordingly to be limited only by the following claims.

We claim:

1. An inking unit apparatus for use in transporting a liquid medium along the surface covering of a rotatable cylinder carrying the liquid medium in the direction of the longitudinal axis of the cylinder, said inking unit apparatus comprising:

at least one driving roller;

a plurality of guide pulleys rotatably positioned at a distance from said driving roller;

a plurality of endless ink equalizing belts, each of said endless ink equalizing belts extending between said driving roller and one of said guide pulleys, each of said endless ink equalizing belts having an outer surface layer capable of accepting the liquid medium and being in contact with the cylinder carrying the liquid medium; and mobile transfer means contacting said outer surface layers of adjacent ones of said endless ink equalizing belts to transfer the liquid medium between said endless ink equalizing belts.

2. The apparatus of claim 1 wherein said mobile transfer means is a rotatable ink transfer roller.

3. The apparatus of claim 1 wherein said mobile transfer means is an endless ink transport belt.

* * * * *